US005440330A

United States Patent [19]

Anderson et al.

[11] Patent Number: 5,440,330

[45] Date of Patent: Aug. 8, 1995

[54] METHOD AND APPARATUS FOR KOGATION REMOVAL FROM A HEATER ELEMENT OF A THERMAL INK JET PRINTER

[75] Inventors: David G. Anderson, Ontario; Dale R. Ims, Webster; Michael P. O'Horo, Fairport, all of N.Y.

[73] Assignee: Xerox Corporation, Stamford, Conn.

[21] Appl. No.: 197,577

[22] Filed: Feb. 16, 1994

Related U.S. Application Data

[63] Continuation of Ser. No. 937,317, Aug. 31, 1992, abandoned.

[51] Int. Cl.[6] ..... B41J 2/05

[52] U.S. Cl. ..... 347/26; 347/62

[58] Field of Search ..... 347/56, 26, 22, 62; 134/1, 19

[56] References Cited

U.S. PATENT DOCUMENTS

| | | | |
|---|---|---|---|
| 4,692,777 | 9/1987 | Hasumi | 347/23 |
| 4,791,435 | 12/1988 | Smith | 347/14 |
| 4,872,028 | 10/1989 | Lloyd | 347/14 |
| 4,929,964 | 5/1990 | Sato | 347/62 |
| 5,036,337 | 7/1991 | Rezanka | 347/60 |
| 5,062,892 | 11/1991 | Halko | 106/22 |
| 5,169,437 | 12/1992 | You | 106/20 D |

OTHER PUBLICATIONS

Hackleman, David; Where the Ink Hits the Paper, Hewlett-Packard Journal, May 1985, p. 32.

*Primary Examiner*—Joseph W. Hartary
*Attorney, Agent, or Firm*—Oliff & Berridge

[57] ABSTRACT

A method for removing kogation deposits or other materials from the heater element of a thermal ink jet printer includes selecting a pulse voltage, pulse width and number of pulses, and apply the selected number of pulses at the selected pulse voltage and pulse width to the heater element to disrupt the kogation deposits. An apparatus for removing kogation deposits or other materials from the heater elements of a thermal ink jet printer includes a controller and a voltage supply, such that the voltage supply is controlled by the controller to supply a selected number of pulses at a selected pulse voltage and a selected pulse width to the heater elements.

35 Claims, 5 Drawing Sheets

METHOD AND APPARATUS FOR KOGATION REMOVAL FROM A HEATER ELEMENT OF A THERMAL INK JET PRINTER

This a continuation of application Ser. No. 07/937,317 filed Aug. 31, 1992, now abandoned.

BACKGROUND OF THE INVENTION

1. Field of the Invention

This invention relates to an apparatus and method for removing kogation material and foreign material and debris from the heater element of a thermal ink jet printer.

2. Description of the Related Art

Thermal ink jet printers operate by heating a portion of liquid ink until the ink vaporizes, thereby expelling a drop of ink from a printhead onto a recording medium, such as paper. The liquid ink is heated in the printhead by means of a resistive heater, one surface of which is in contact with a supply of the liquid ink held in a heater channel or heater chamber. Occasionally, as the liquid ink is heated and vaporized, the ink will undergo thermal breakdown, resulting in deposits known as "kogation" being formed on the exposed surface of the heater element. Eventually, the kogation builds up to such an extent that it begins to act as an insulator between the heater element and the liquid ink, resulting in poor printer performance. This reduction in performance can cause: 1) an increase in "transit" time and a reduction in drop ejection velocity, resulting in poor drop placement on the recording medium; and 2) a reduction in drop volume, resulting in a loss of ink coverage and image quality.

Because kogation results from a thermal breakdown of the liquid ink, prior attempts to deal with the kogation problem have focused on providing inks that either: 1) would not undergo thermal breakdown; or 2) if the inks would undergo thermal breakdown, would not result in kogation formation. However, due to consumers' demand for full color thermal ink jet printers and page-width printheads at reasonable cost, the use of inks which result in kogation cannot be entirely avoided.

Additionally, deposits of other materials can be left on the heater elements of a thermal ink jet printer during the manufacturing process. These manufacturing materials can include residues from the cleaning and etching processes and excess material deposits from the other layers of the printhead. Regardless of the source, these deposits are difficult to detect during the manufacturing process, difficult to remove using conventional techniques, and can significantly affect print quality. While kogation can be avoided by selection of non-kogating inks, that would have no effect on poor print quality due to foreign material deposits arising from the manufacturing process.

SUMMARY OF THE INVENTION

It is thereby an object of the present invention to provide a method and apparatus which can effectively remove kogation and foreign material deposits formed on the heater element of a thermal ink jet printer.

It is another object of the invention to provide a method and apparatus which is able to initiate kogation and foreign material removal from a heater element of a thermal ink jet printer without operator input and prior to the deterioration of printer performance.

It is yet another object of the invention to provide a method and apparatus for kogation removal from a heater element of the thermal ink jet printer in conjunction with the standard maintenance operations of the printer.

It is a further object of the invention to provide a method and apparatus for permitting operator initiation of the kogation removal procedure in a thermal ink jet printer.

It is a further object of the invention to provide a method and apparatus for efficient removal of foreign material debris from the heater elements of a thermal ink jet printer.

These and other objects and advantages are achieved in accordance with the invention by providing an apparatus and method for kogation removal in a thermal ink jet printer, wherein the heater element is connected to a voltage supply means, which is controlled by a control means to supply a selected number of voltage pulses to the heater element, at a selected pulse width and pulse voltage, such that the kogation and foreign material deposited on the heater element is removed.

These and other objects, features and advantages of the present invention are described in or apparent from the following detailed description of the preferred embodiments of the invention.

BRIEF DESCRIPTION OF THE DRAWINGS

The preferred embodiments will be described with reference to the drawings, in which like elements have been denoted with like reference numerals throughout the figures, and in which.

DETAILED DESCRIPTION OF THE PREFERRED EMBODIMENTS

Figure 1:
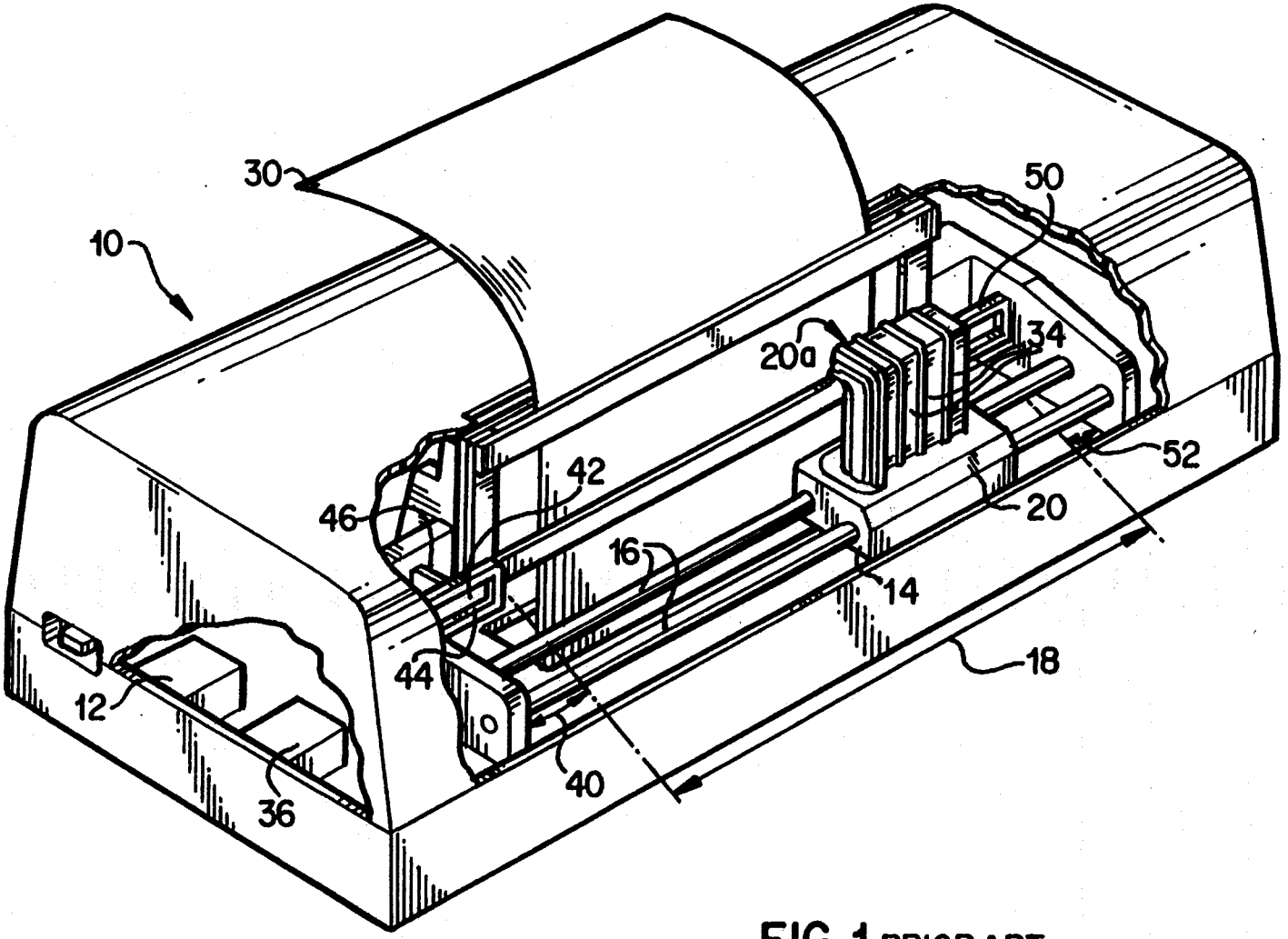
FIG. 1 PRIOR ART
FIG. 1 is a perspective view of a thermal ink jet printer of the present invention.
Figure 5:
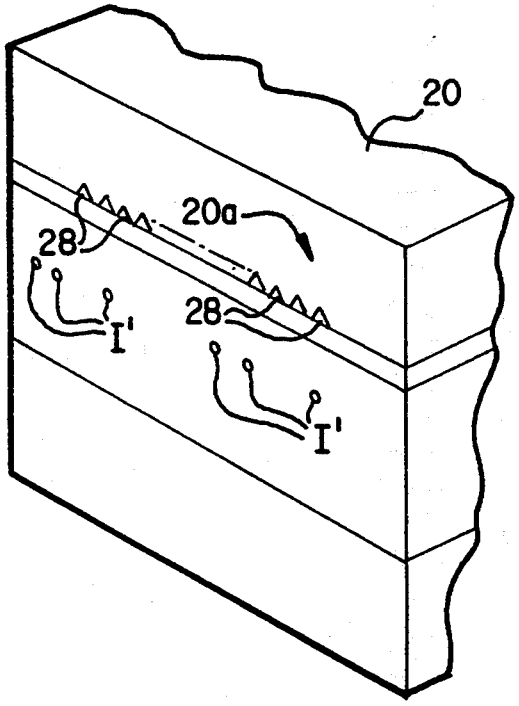
FIG. 5 PRIOR ART
FIG. 5 is a perspective view of the print head of FIG. 2.
Figure 2:
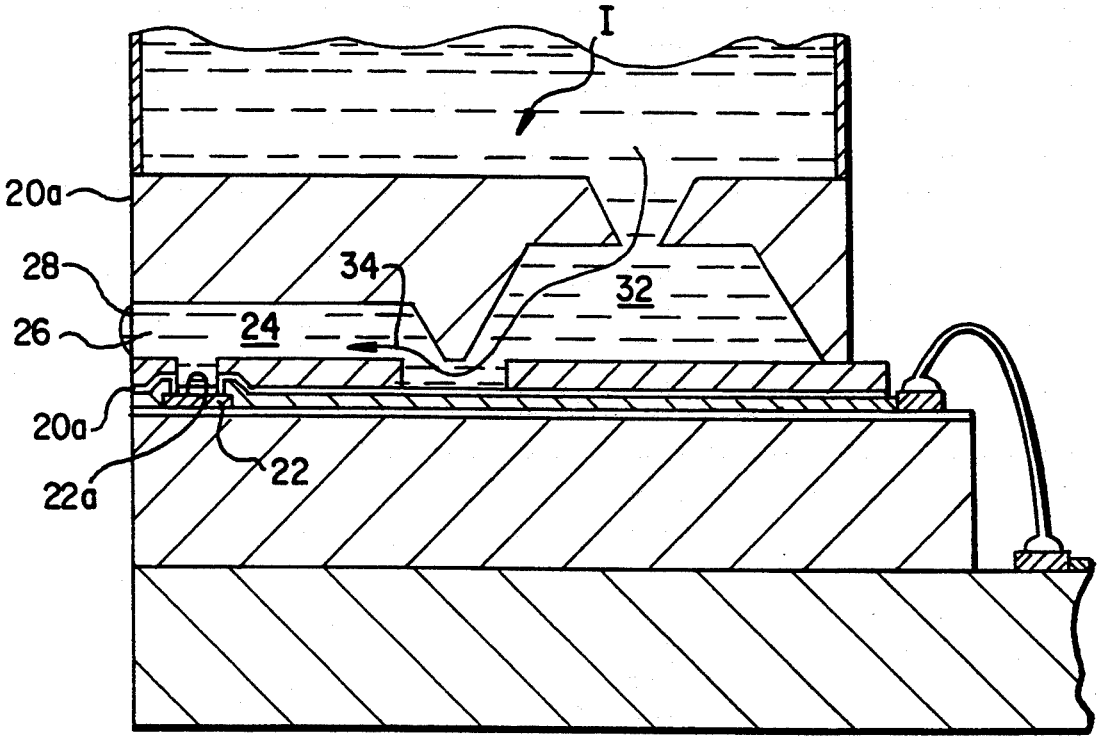
FIG. 2 PRIOR ART
FIG. 2 is a sectional view of the printhead of the thermal ink jet printer system of the present invention.

Referring to FIGS. 1, 2 and 5, in a first preferred embodiment of the present invention, a thermal ink jet printer 10 comprises a controller 12, a servo motor 14 for moving a printhead 20 along a carriage 16 between a printing station 18 and a capping station 40. As shown in FIG. 2, the printhead 20 comprises a heater element 22 having one surface **22*a* exposed to liquid ink 1 in heater chamber or channel 24. A delivery means 26 comprising a nozzle or the like 28 delivers the liquid ink I to the recording medium 30. An ink supply 32 conveys the liquid ink I from an ink reservoir 34 to the heater channel 24**.

A voltage supply 36 is connected to the heater element 22 and controlled by the control means 12.

In the capping station 40, a cap 42 and gasket 44 are provided. The cap 42 and gasket 44 are shaped so as to fit snugly over a first surface **20*a* of the printhead 20 to prevent the liquid ink from being contaminated or evaporating. When the printhead 20 is at the capping station 40, a capping linkage 46 moves the cap 42 and gasket 44 between a first position wherein the printhead 20 is uncapped and a second position wherein the printhead 20 is loosely capped. The capping linkage 46** is driven by a capping servomotor (not shown) between the first and second positions.

In operation, the printhead 20 is maintained at the capping station 40 in a capped state, with the cap 42 and gasket 44 in the second position, when the thermal ink jet printer 10 is in an "off" mode. When the thermal ink jet printer 10 is placed in an "on" mode, the printhead 20 is uncapped by moving the cap 42 and gasket 44 to the first or uncapped position, and moving the printhead 20 to a printing position within the printing station. The heater element 22 is supplied with an operating voltage by the voltage supply 36.

The nucleation temperature is the temperature at which the liquid ink I undergoes a phase change from a liquid state to a gaseous state. The thermal ink jet printer of the present invention, the liquid inks used have a nucleation temperature in the range of 250° C. to 300° C. The operating voltage is the voltage which must be supplied to the heater element 22 to raise the temperature of the ink I in the heater channel 24 to a point at or above the nucleation temperature. The threshold voltage is the minimum voltage required to produce a droplet of ink of a given volume for the chosen pulse length.

Figure 3A:
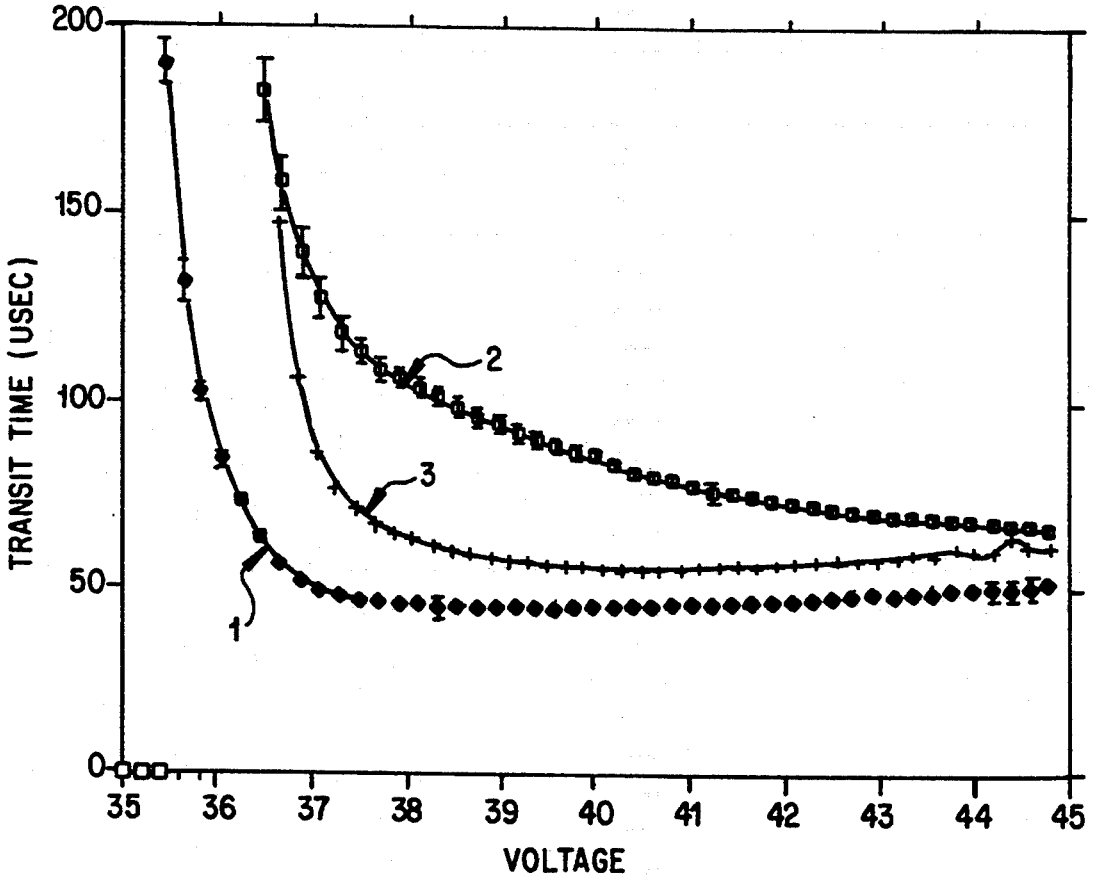
FIG. 3A is a graph showing the performance of a thermal ink jet printing head before and after an exemplary kogation removal operation for a representative ink formulation.

At the threshold voltage, the transit time of the drop as it travels from the nozzle 26 to the image receiving member is high, and therefore, the drop velocity is low. In the example in FIG. 3A, curve 1 represents the threshold (or performance) curve of an essentially "clean" heater element 22. Curve 1 shows the threshold curve of a heater element 22 after 500,000 droplet firings. (The 500,000 pulses are needed to stabilize the performance of the printhead.) As shown in FIG. 3A, curve 1 has a well defined "knee" representing the threshold voltage. To the left of the threshold voltage, the transit times are high and vary considerably with a small change in operating voltage. To the right of the threshold voltage, the transit times are low, and essentially constant over a wide range of operating voltages.

In the thermal ink jet printer of the present invention, the threshold voltage is in the range of 5 V to 60 V, preferably in the range of 32 V to 38 V, while the operating voltage is in the range of 5 V to 60 V, preferably in the range of 32 V to 45 V. The growth rate of the kogation layer on the surfaces **22*a* of the heater elements 22 is dependent on the amount the operating voltage applied to the heater elements 22, the overvoltage, exceeds the threshold voltage. For a typical ink formulation, the normal operating voltage for a thermal ink jet printer is generally 5%–15% higher than the threshold voltage of the ink. This higher operating voltage assures that a stable droplet is produced by each heater element 22 of the printhead 20**.

Figure 3B:
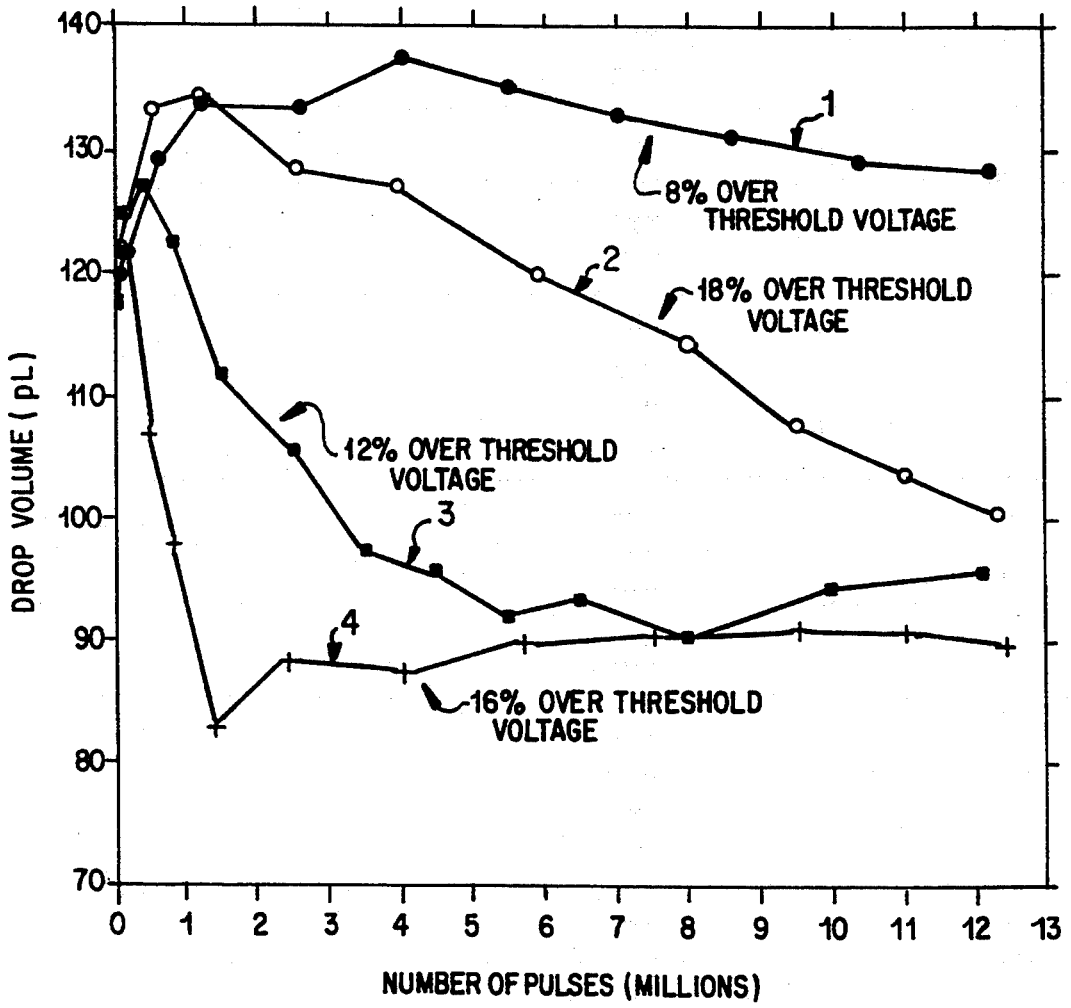
FIG. 3B is a graph showing the change in drop volume due to kogation deposits as function of the number of pulses and the pulse overvoltage.
Figure 4:
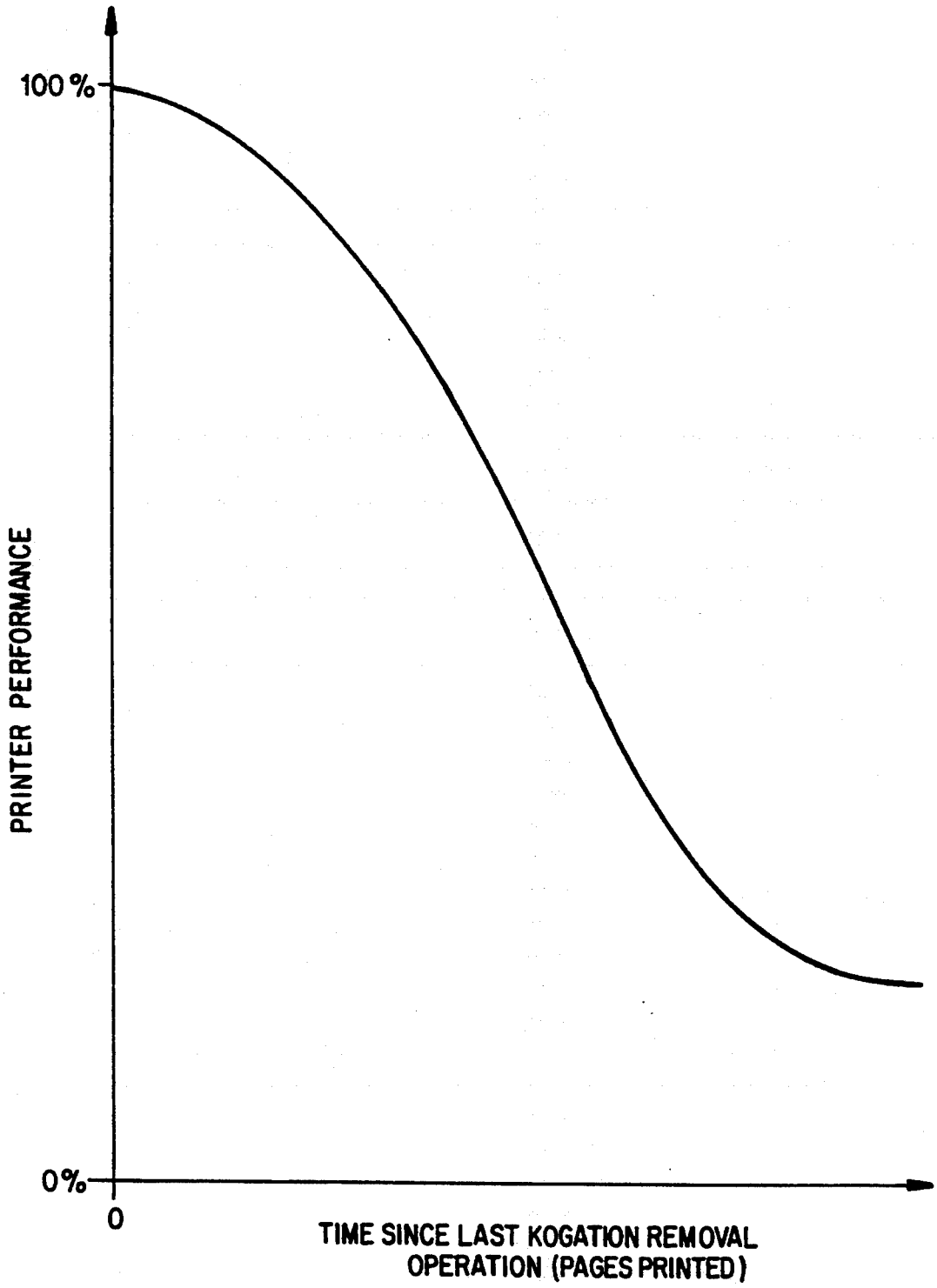
FIG. 4 is a graph of the relationship between printer performance and printer use between kogation removal events for a representative ink formulation.

As shown in FIG. 3B, the amount the operating voltage exceeds the threshold voltage significantly affects the build up of the kogation layer, which directly results in a reduction in the drop volume. At an operating voltage 8% over the threshold voltage, the kogation layer buildup, and therefore the drop volume reduction, occurs slowly, and only becomes significant above 4 million pulses. In contrast, a 10% or 12% overvoltage causes the kogation layer, and therefore the drop volume reduction, to build up quickly, becoming significant at 1 million pulses or less. Finally, a 16% overvoltage causes the kogation layer, and therefore the drop volume reduction, to occur rapidly, becoming significant immediately and reaching the point of maximum reduction of the drop volume within 2 million pulses.

Due to fabrication tolerances, the actual resistance value of the heater elements 22 of the printhead 20 will vary over some range. Likewise, the voltage supply 36 has a tolerance range for a given output voltage. Finally, the voltage drops on the voltage supply leads within and outside of the printhead 20, resulting from the combined data-dependent current flow, and the varying resistance of the varying number of heater elements 22 of the printhead 20 being used at any instant will cause the actual operating voltage on the heater elements 22 to vary.

Accordingly, the operating voltage of the printhead 20 must be chosen so that the operating voltage at the heater element 22 most electrically remote from the power supply 36 is sufficiently greater that the threshold voltage. However, this necessarily results in subjecting the ink I in a heater channel 24 of an electrically nearer heater element 22, when the nearer heater element 22 is fired by itself, to an operating voltage far exceeding the threshold voltage.

To print, the printer 10 is placed in a "print" mode whereby the printhead 20 is positioned along the carriage 16 at a position opposite a location L on the paper 30 where an image is to be formed. The heater element 22 is provided with the operating voltage by the voltage supply 36 to vaporize the ink I in the heater channel 24, thereby expelling a drop of ink I' from the delivery means 26 onto the paper 30. In continuous printing, the operating voltage is continuously supplied to the heater elements 22 in 3μsec pulses. An ink droplet is produced each time a 3μsec pulse is applied to the heater elements 22. Following drop ejection ink is then drawn out of the reservoir 34 through the ink supply 32 by capillary force to refill the heater channel 24 and delivery means 26.

When the printer 10 is placed in the "off" mode the printhead 20 returns to the capping station 40, and the cap 42 and gasket 44 are moved to the second position, over the first face **20*a* of the printhead 20**.

In a first preferred embodiment of the kogation removing method and apparatus, when a kogation removal operation is desired, the printhead 20 is moved to the capping station 40 and capped by the cap 42 and gasket 44. The cap 42 and gasket 44 are first moved to the second position, into contact with the first surface **20*a* of the printhead 20, by the capping linkage 46 and capping servo motor 48. To remove the kogation deposits, the delivery means 26 and heater channel 24 are first drained of the ink I by moving the cap 42 and gasket 44 from the second position to a third position. In the third position, the gasket 44 is compressed between the cap 42 and the first face 20*a* of printhead 20, thereby creating a positive pressure at the nozzle 28 of the delivery means 26. Creating a positive pressure causes the ink I to be forced back from the delivery means 26 and the heater channel 24 into the ink supply 32**.

In the first preferred embodiment, after the heater channel 24 is drained of the ink I, the controller 12 determines a number of removal pulses to be applied to the heater element 22, and a removal pulse width and a removal pulse voltage. The removal pulse number, pulse width, and pulse voltage are determined according to the volume of printing, in number of pulses, since the last kogation removal operation, and the degree by which the operating voltage exceeds the threshold voltage of the ink. Alternatively, the pulse number, pulse width and pulse voltage can be selected based on whether the degree of kogation is light or heavy. The degree of kogation can be determined by a sensor which measures drop volume or transit time. Alternatively, the degree of kogation is determined by the operator based on his subjective appraisal of the print quality.

The effect of kogation, and kogation removal, are shown in FIG. 3A. In the example in FIG. 3A, curve 1 represents the threshold (or performance) curve of an essentially "clean" heater element 22. Curve 1 shows the threshold curve of a heater element 22 after 500,000 droplet firings, which is sufficient use to remove all transient effects arising in a new heater. As shown in FIG. 3A, curve 1 has a well defined "knee" representing the threshold voltage. To the left of the threshold voltage, the transit times are high and vary considerably with a small change in operating voltage. To the right of the threshold voltage, the transit times are low, and essentially constant over a wide range of operating voltages.

As shown in curve 2 of FIG. 3A, a typical thermal ink jet printer printhead, using typical liquid ink which is known to form kogation, was subjected to a total of 12,000,000 droplet firings. After ejecting 12,000,000 droplets, curve 2 of FIG. 3B shows that kogation deposits on the one surfaces 22a of the heater elements 22 have reduced the droplet volume by approximately 20 pL from the initial value of 120 pL and curve 2 of FIG. 3A shows that the kogation deposits have increased the transit time by 40 μsec over the initial values of curve 1 (at an operating voltage of 40 V, an overvoltage of 11% over the threshold voltage of 36 V). The effect of the kogation deposits is to reduce drop volume and raise transit times, thereby reducing the solid area density in the images formed on the paper 30. The kogation deposits also reduces drop placement accuracy. The curve 2 of FIG. 3A, representing the threshold curve of the kogation covered heating elements 22, shows a generally raised transit time for any particular operating voltage, and a "softened" knee, indicating that the "threshold voltage" is no longer a precisely identifiable part of the threshold curve. Further, the transit time is no longer approximately constant above the threshold voltage. Curve 2 of FIG. 3B, shows that the drop volume has fallen, and will continue to do so.

In contrast, as shown by curve 3 of FIG. 3A, after subjecting the kogation covered heater elements 22 to 1,000,000 kogation removal pulses, the performance of the printhead 20 had returned almost to the level of curve 1. In the example shown in FIG. 3A, the kogation removal operation was performed at a pulse voltage of 43 V, for 1,000,000 pulses at a pulse width of 3 μsec. The kogation removal operation was performed "in air", that is, with the ink removed from the channel 24. The kogation removal operation was performed at a variety of pulse frequencies from 2 KHz to 4 KHz, which is the normal range of pulse frequency during operation. The results of the kogation removal operations over this frequency range were substantially independent of the frequency.

The number of pulses providing effective kogation removal ranges from approximately 500,000 to 2,000,000 pulses and varies inversely with either the pulse voltage or the pulse width. Below 500,000 pulses, the kogation is not fully removed, while above 2,000,000 pulses, the kogation is substantially entirely removed, and continued use of the heater element 22 in air results in overheating of the heater elements and a resulting permanent degradation in performance. In general, the pulse voltage and pulse width can vary inversely, so long as sufficient heating of the heater elements 22 per pulse is obtained. The kogation removal pulse voltage can range over the range of operation voltages (i.e., 5–60 V), so that no alteration of the power supply 36 is necessary to provide kogation removal capability. Likewise, since kogation removal is essentially independent of frequency, the normal range of operating frequency is sufficient, and again no alteration of the power supply 36 (or the controller 12) is necessary. The pulse width can range from 1.51 μsec–10 μsec, while the standard operating pulse width of 3 μsec is preferred, as this again requires no alteration of the power supply 36 or the controller 12.

As shown in curve 3 of FIG. 3A, the transit time had decreased approximately 30 μsec (for an operating voltage of 40 V). Further, the threshold voltage is clearly defined and the transit time at the operating voltage is again approximately constant. Additionally, drop volume has increased approximately 20 pL. While the transit times and threshold voltages of curve 3 are sightly higher than the initial values shown by curve 1, this is due to heater aging, as opposed to kogation deposits.

Once the pulse parameters have been selected, the voltage supply 36 is controlled by the controller 12 to apply the selected number of pulses at the selected pulse width and pulse voltage to the heater element 22, thereby disrupting the kogation deposits and causing them to flake off or otherwise dislodge from the one surfaces 22a of the heater elements 22.

After applying the selected pulse parameters to the heater element 22, the cap 42 and gasket 44 are moved from the third position to the second position, thereby relieving the overpressure on the heater channel 24 and the delivery means 26. It is likely that a vacuum reprime will be required to refill the heater channels 24 and delivery means 26 after the kogation removal operation.

Alternatively, in a second preferred embodiment of the method and apparatus for effecting kogation removal, printhead 20 is moved from the printing position to a maintenance station 52. In the maintenance station 52, the delivery means 26 of printhead 20 is positioned opposite a disposal means 50 for absorbing maintenance drops I' of the ink I ejected from the printhead 20. In the second preferred embodiment, the heater channels 24 are not drained, and the heater elements 22 are in a maintenance mode. As in the first preferred embodiment, the kogation removal parameters are determined from the amount of printing since the last kogation removal event, and the removal voltage is applied to the heater element. However, the range for the number of pulses for the second preferred embodiment is 5000–20,000 rather than 500,000 to 2,000,000. Additionally, the operating frequency is in the range of 6 kHz–9 kHz for the kogation removal operation. The pulse width and pulse voltage remain in the normal ranges.

The number of pulses for the maintenance embodiment is reduced because it is anticipated that any kogation deposits forming between maintenance operations will be light. Additionally, unnecessary waste of ink is avoided. The pulse frequency can be increased because excessive heat build-up is avoided, both by the lower number of pulses and by the heat loss through the ejected ink drops I'. Again, in general, the removal pulse voltage and removal pulse width will vary proportionately with the amount of printing performed since the previous kogation removal operation. The selected parameters are applied to the heater elements 22 by the voltage supply 38, which is controlled by the controller 12.

In operation, in the second preferred embodiment, the heater elements 22 are heated to at least the nucleation temperature, causing the ink I to vaporize and drop I' to be expelled from the delivery means 26 and to the disposal means 50. However, because the voltage supplied to the heater elements 22 by the voltage supply 36 is not immediately reduced, the vaporized ink is not allowed to condense, and the flow of ink I from the ink supplies 32 into the heater channels 24 is prevented. Accordingly, the heater elements 22 overheat and the kogation deposits are disrupted and flake off or otherwise dislodge from the one surfaces 22*a* of the heater elements 22.

Alternatively, in either the first or second preferred embodiments of the kogation removal method, the operator is able to override the kogation removal interval established in the controller 12 in response to a drop in print quality. In general, when print quality is reduced to the point where it becomes noticeable to the operator, large kogation deposits will have formed on the heater element 22.

In another alternative format of the second preferred embodiment, the kogation removal procedure is added to the normal maintenance routine of the printer. Normal maintenance on a thermal ink jet printer can be performed: 1) prior to printing, especially after an extended period in the "off" mode; 2) during printing, during an extended printing sequence (such as when printing a non-text image); or 3) after printing, just prior to entering the "off" mode. In general, when performing the maintenance routine, the printhead 20 is moved to the maintenance station 52, and drops of ink I' may be expelled from the printhead 20 into the disposal means 50. The kogation removal procedure, implemented using the second preferred embodiment, can be added to the maintenance routine to remove the kogation deposits before they accumulate to a point where print quality is affected. In this case, the step of determining a kogation removal event based on the period since the last kogation removal event can be skipped.

In a third embodiment of the thermal ink jet printer, using a page-width printhead, either the capping embodiment or the maintenance station embodiment can be used. In this third embodiment, a page-width maintenance station can be provided. This page-width maintenance station is used as outlined with respect to the maintenance station of the second preferred embodiment. In a fourth preferred embodiment, a page-width cap is provided. This page-width cap is used as outlined above with respect to the cap of the first preferred embodiment.

In a fifth embodiment, the movable or page-width printhead is detachably connected to the thermal ink jet printer. When kogation or other material deposits are such that print quality is affected, the operator or a service technician replaces the used printhead with a replacement printhead, returning the used printhead to a service center or a manufacturing plant for the removal operation.

The kogation material adheres very tenaciously to the heater surface and is very difficult to remove by other means or methods than described in this invention. Under different conditions other materials are known to coat the heater surface and cause printer performance deterioration. The disclosed method will remove these other undesirable materials as well.

Accordingly, a newly manufactured or reconditioned printhead can also be subjected to a material removal operation before being installed into a thermal ink jet printer. In either case, the used or newly manufactured printhead could be subjected to either the first or second embodiments of the material removal operation. The used or newly manufactured printhead is connected to a refurbishing jig, which cycles the printhead through either the dry removal operation of the first embodiment or the wet removal operation of the second embodiment. Accordingly, the kogation deposits of the reconditioned printhead, or the manufacturing material deposits of the newly manufactured printhead will be removed.

While this invention has been described in conjunction with specific embodiments thereof, it is evident that many alternatives, modifications and variations will be apparent to those skilled in the art. Accordingly, the preferred embodiments of the invention as set forth herein are intended to be illustrative, not limiting. Various changes may be made without departing from the spirit and scope of the invention as defined in the following claims.

What is claimed is:

1. A method for removing foreign material from a heater means of a thermal ink jet printer, the printer including driving means for driving the heater means with ejection voltage pulses to eject some ink from the thermal ink jet printer onto a print medium and for driving the heater means with removal voltage pulses to remove the foreign material remaining after the ejection voltage pulses, said removal voltage pulse differing from said ejection voltage pulses, wherein a portion of the ink adheres to a surface of the heater means as kogation and comprises at least part of the foreign material, the foreign material removal method comprising the steps of:

selecting a number of removal voltage pulses, a removal pulse width and a removal pulse voltage;

controlling the driving means to generate the selected number of removal voltage pulses at the selected removal pulse width and selected removal pulse voltage; and driving the heater means with the selected number of removal voltage pulses at the selected removal pulse width and selected removal pulse voltage to remove the foreign material.

2. The method of claim 1, including selecting the pulse width and pulse voltage to vary in an inverse relationship to one another.

3. The method of claim 1, including selecting the number of pulses and pulse voltage to vary in an inverse relationship to one another.

4. The method of claim 1, including selecting the number of pulses and the pulse width to vary in an inverse relationship to one another.

5. The material of claim 1, where the foreign material is at least one of kogation material and manufacturing residue.

6. The method of claim 1, further comprising the steps of:

draining a volume of liquid ink from a heater channel of a thermal ink jet printer prior to the applying step; and refilling the heater channel with a volume of liquid ink after the applying step, wherein the selected number of removal pulses, removal pulse width and removal voltage are selected based on the heater channel being empty during an application of the removal pulses.

7. The method of claim 6, wherein the selected number of pulses is in a range of substantially 50,000 to 200,000 pulses.

8. The method of claim 6, wherein the selected pulse width is in a range of substantially 1 μsec to 10 μsec.

9. The method of claim 6, wherein the selected pulse voltage is in the range of 32 V to 45 V.

10. The method of claim 1, wherein the selected number of pulses is determined by a print volume between a current removal operation and a previous removal operation.

11. The method of claim 1, further comprising the step of selecting the number of removal pulses, removal pulse width and removal pulse voltage based on the heater channel being filled during an application of the removal pulses.

12. The method of claim 11, wherein the selected number of pulses is in the range of substantially 5,000 to 20,000 pulses.

13. The method of claim 11, wherein the selected pulse width is in a range of substantially 1 μsec to 10 μsec.

14. The method of claim 11, wherein the selected pulse voltage is in the range of 32 V to 45 V.

15. The method of claim 1, further comprising the step of initiating a removal operation after a predetermined printing volume from a previous removal operation, wherein the selected number of pulses, pulse width and pulse voltage are predetermined based on the predetermined printing volume.

16. The method of claim 1, further comprising the step of initiating a removal operation at a variable interval from a previous removal operation, wherein the selected number of pulses, pulse width and pulse voltage are predetermined based on the variable interval.

17. The method of claim 16, wherein the material removal is initiated by the operator, and includes selecting the pulse number, pulse voltage and pulse width to remove heavy material deposits.

18. The method of claim 16, wherein the material removal is initiated by a controller as part of a maintenance routine, and includes selecting the pulse number, pulse voltage and pulse width to remove light material deposits.

19. The method of claim 1, further comprising the steps of:

placing the heater means into a refurbishing station; and determining the amount of foreign material on the heater means, wherein the selected number of removal pulses, removal pulse width and removal voltage are selected based on the determined amount of foreign material.

20. The method of claim 33, wherein the determining, selecting and applying steps are repeated until the heater means is substantially free of the foreign material.

21. The method of claim 1, wherein the number of removal pulses, pulse voltage and pulse width are selected based on the foreign material to be removed.

22. An apparatus for removal of foreign material from a heater element of a thermal ink jet printer, comprising:

a print head comprising at least one heater element for heating liquid ink and a delivery means for delivering the liquid ink from the at least one heater element to a recording medium, a portion of the liquid ink adhering to the at least one heater element as kogation and comprising at least part of the foreign material forming on a first surface of each at least one heater element;

an ink reservoir for storing the liquid ink;

an ink supply for supplying the liquid ink from the reservoir to the heater;

a voltage supply connected to each at least one heater element for supplying an operating voltage to each at least one heater element and for supplying a removal voltage to each at least one heater element, wherein the removal voltage is sufficient to remove the foreign material not removed by the operating voltage; and a controller for controlling the voltage supply, wherein the controller controls the voltage supply to supply the removal voltage to the at least one heater element to remove the foreign material from each at least one heater element.

23. The thermal ink jet printer of claim 22, where the material is at least one of kogation material and manufacturing residue.

24. The thermal ink jet printer of claim 22, further comprising:

drain means for controlling a presence of the liquid ink in the at least one heater element, wherein the controller also controls the drain means.

25. The thermal ink jet printer of claim 24, wherein the controller controls the drain means to prevent the liquid ink from entering the at least one heater element and controls one of the voltage supply and drain means to remove the liquid ink from the at least one heater element.

26. The thermal ink jet printer of claim 22, wherein the controller controls the voltage supply to supply at least one kogation removal pulse to each at least one heater element to remove the kogation material, the at least one kogation removal pulse having a selected pulse width and a selected pulse voltage.

27. The thermal ink jet printer of claim 26, wherein the selected pulse voltage is in a range of substantially 32 V to 45 V.

28. The thermal ink jet printer of claim 26, wherein the selected pulse width is in a range of substantially 500,000 to 2,000,000.

29. The thermal ink jet printer of claim 26, wherein the selected pulse width is in a range of substantially between 1.5 μsec to 1 μsec.

30. The thermal ink jet printer of claim 24, wherein the drain means comprises a cap having a flexible compressible gasket for providing an air-tight seal over an exposed end of the delivery means; and a cap moving means for placing the cap into contact with the exposed end of the delivery means;

wherein the cap moving means compresses the gasket against the exposed end of the delivery means to create a drain pressure on the liquid ink, thereby forcing the liquid ink out of the at least one heater element and back into the supply means.

31. The thermal ink jet printer of claim 30, further comprising a capping station, the cap and capping moving means located in the capping station and the print head movable between the capping station and a printing station.

32. The thermal ink jet printer of claim 22, further comprising a disposal means for removing liquid ink delivered by the delivery means during a maintenance operation of the print head.

33. The thermal ink jet printer of claim 32, wherein the selected pulse voltage is in a range of substantially 32 V to 45 V.

34. The thermal ink jet printer of claim 32, wherein the selected number of pulses is in a range of substantially 5,000 to 20,000 pulse.

35. The thermal ink jet printer of claim 32, wherein the selected pulse width is in a range of substantially between 1.5 μsec to 10 μsec.

* * * * *